United States Patent [19]

Olsson

[11] 4,193,169

[45] Mar. 18, 1980

[54] METHOD OF STRIPPING PULP BALES AND A MACHINE THEREFOR

[76] Inventor: Carl F. S. Olsson, Kampastigen 4, Vaxjo, Sweden, S-352 52

[21] Appl. No.: 903,302

[22] Filed: May 5, 1978

Related U.S. Application Data

[63] Continuation of Ser. No. 624,581, Oct. 22, 1975, abandoned.

[30] Foreign Application Priority Data

Oct. 23, 1974 [SE] Sweden ..... 7413329

[51] Int. Cl.[2] ..... D01G 7/02

[52] U.S. Cl. ..... 19/80 R

[58] Field of Search ..... 19/80 R, 81, 145.5; 241/101.7, 101 A

[56] References Cited

U.S. PATENT DOCUMENTS

| | | | |
|---|---|---|---|
| 2,792,183 | 5/1957 | Fasching et al. | 241/101 A |
| 3,101,513 | 8/1963 | Wildbolz | 19/80 R |
| 3,135,022 | 6/1964 | Binder | 19/80 R |
| 3,360,831 | 1/1968 | Morikawa et al. | 19/80 R |
| 3,472,298 | 10/1969 | Vinogradov et al. | 241/101.7 X |
| 3,822,042 | 7/1974 | Roy | 241/101.7 X |

FOREIGN PATENT DOCUMENTS

| | | | |
|---|---|---|---|
| 841216 | 7/1960 | United Kingdom | 19/80 R |
| 988977 | 4/1965 | United Kingdom | 19/80 R |

*Primary Examiner*—Werner H. Schroeder

*Attorney, Agent, or Firm*—Pollock, Vande Sande & Priddy

[57] ABSTRACT

A method and an apparatus is disclosed for a coarse defibering of pulp bales with tools that work over the entire cross section of the bales in such a way that the tools strike against the feeding direction of the bales and lifts the fibers out of the bale.

22 Claims, 6 Drawing Figures

METHOD OF STRIPPING PULP BALES AND A MACHINE THEREFOR

Figure 1:
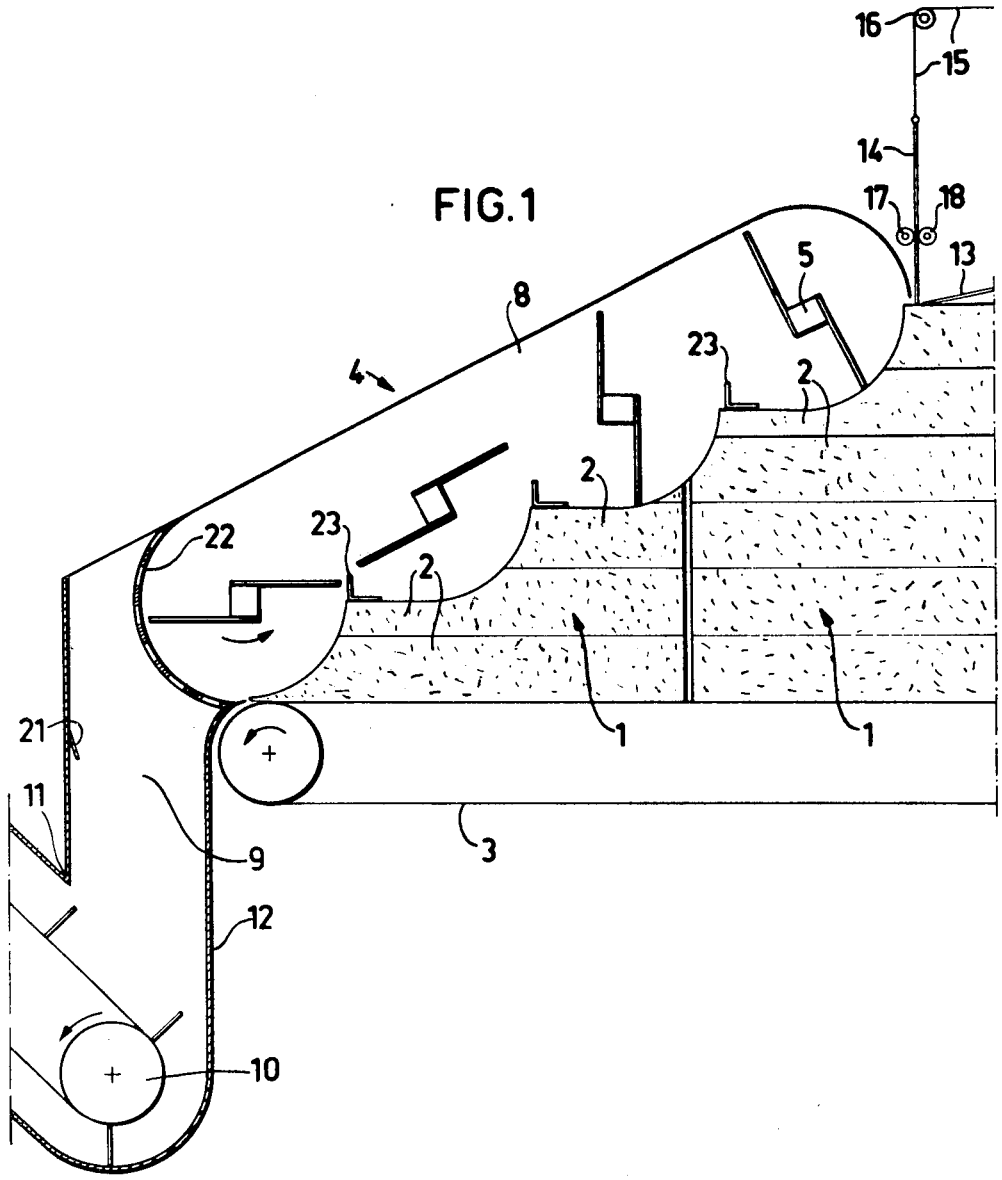

This is a continuation of application Ser. No. 624,581 filed Oct. 22, 1975, now abandoned.

This invention relates to stripping of pulp bales, i.a. in manufacture of fluff for diapers and similar sanitary products. Such products are at present made starting from a band-shaped chemical pulp in rolls, which pulp is fed into a mill, usually of hammer type, breaking the band so that the fibers are made free. However, for economical reasons attempts have instead been made to start from a chemical sheet pulp or mechanical pulp, which is cheaper. However, the means known so far for defibration of pulp result in a considerable shortening of the fibers reducing the quality of the final product.

For stripping whole pulp bales two different stripping means have so far i.a. been used. In one of these (Swedish patent specification No. 355,613) the bale is cut transversely to the direction of the sheets about 3 cm from the front edge of the bale, after which the strips obtained in this way are defibered by means of two mills. In the other stripping means (Swedish Pat. No. 334,811) the sheets of the bale are stripped by means of a plurality of toothed stripping rods arranged below the surface of the lowermost sheet.

In the first-mentioned stripping means known a certain shortening of the fibers is obtained by the cutting. In the other stripping means a shortening of the fibers is obtained when the tools saw into the sheets from their surface.

It is the object of the present invention to achieve a coarse defibration of whole bales, especially such of slab type, an optimization of the fiber quality being obtained because working is effected the whole time with tools without edges, operating contrary or obliquely to the feed direction of the fiber layers. The invention relates to a stripped product with no or little destroying of the fibers as a consequence of the working. The machine of the invention is intended to be combined with one additional defibration step to obtain a complete defibration.

Here a so-called flake-dried pulp in bales is intended by bales of slab type. Such pulp is substantially produced in the following way. The diluted pulp suspension having a concentration of 3–5% is pumped to a wet machine. In this the pulp is dewatered on a roll screen or flat wire with following presses or else directly in a press nip to 45–50% dry content. Then the pulp bale is defibered in a fluffer and the fluffed pulp is conveyed pneumatically to a drying apparatus. The drying can be divided into two or more steps. The fluffed wet pulp (the flakes, the fiber agglomerates) are then separated in a wet pulp cyclon and fall down into the injector of the first step. The pulp is mixed here with hot drying gases and is transported under drying via a fan and a drying line to a drying cyclon, where pulp is separated and falls down into the second drying step. In the following drying step the process is repeated, after which the finally dried pulp falls down into a cooling step. From this the pulp is conveyed pneumatically to a slab press.

The slab press comprises a form, into which the fiber agglomerates fall down. When a certain amount of fiber agglomerate has been supplied to the form, the supply is stopped, and a press plate with the internal dimensions of the form is pressed down into the form and presses the fiber agglomerates together. The press plate is lifted and a new amount of fiber agglomerate is filled into the form to be compressed anew by the press plate. This process is repeated until the contents of the form have reached a height of 8–12 cm, when the contents of the form are removed in the form of a disc.

Thus, at each pressing operation a new fiber layer has been formed. These fiber layers are well visible in the outer edges of the finished disc (plate). Each layer consists of hard compressed and flattened fiber agglomerates. Usually 4–6 of such discs are placed upon each other, after which they are additionally compressed in a conventional bale press to a bale having a weight of 200–250 kg, which will then have a volume weight of about 800 kg/m$^3$.

If one intends to disintegrate such a bale it will be found that the slabs can easily be separated from each other. It is much more difficult to disintegrate a certain slab. This is done most easily if a knife-blade or the like is inserted between two superficially lying fiber layers and the disc is stripped from above layer by layer. Therefore the working according to the invention is i.a. carried out in accordance with this method. When a bale with horizontally lying discs is fed towards the working tools of the invention, the uppermost fiber layer of the uppermost disc will first be hit by the stops of the tools. If the uppermost fiber layer is at the same height over the conveyor belt as the tool tip, when the latter is in a position vertically to the shaft center, the tool tip will strike against the horizontally placed fiber layer against the feed direction of the layer. However, if the uppermost fiber layer is at the same height over the conveyor belt as the tool tip, when the latter is at the same height as the shaft centre, the tool tip will expose the fiber layer to a stop almost straight from below and lift it upwards. All the other stopping angles are included between these two extremes.

The invention will be described below more in detail in connection with the enclosed drawings showing an embodiment of a machine for carrying out the method.

Figure 2:
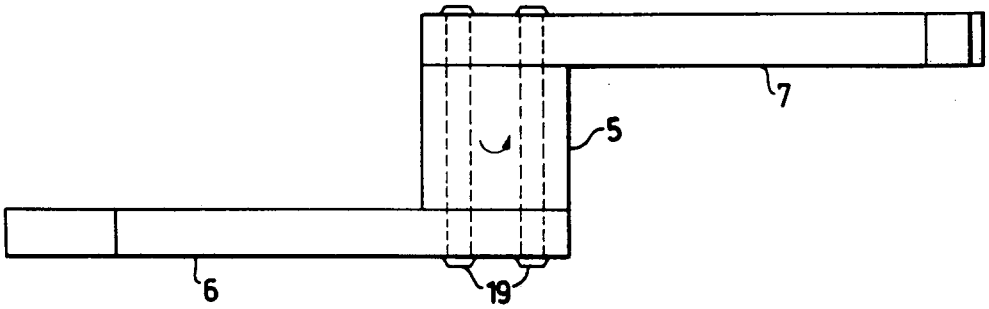
Figure 3:
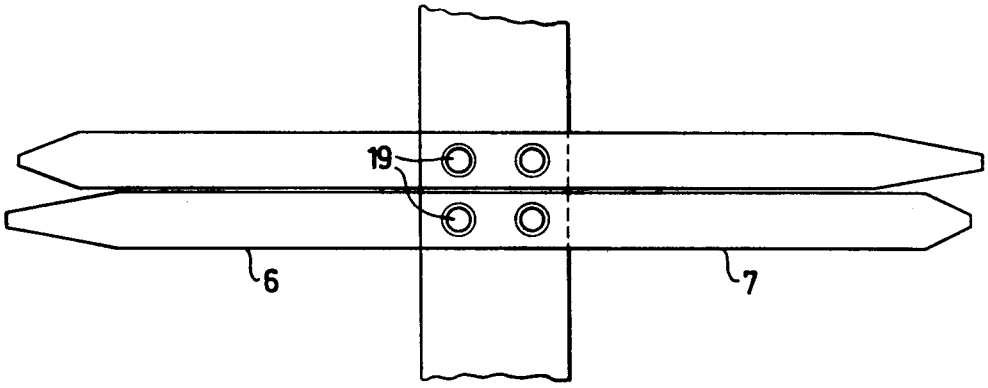
Figure 4:
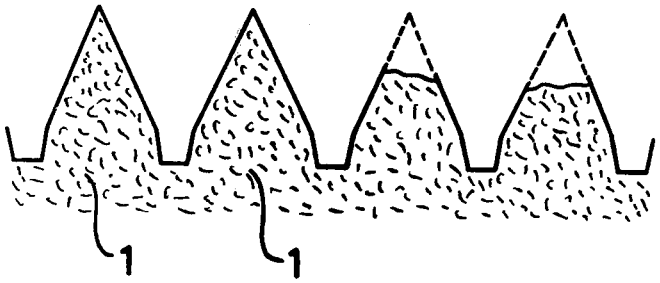
Figure 6:
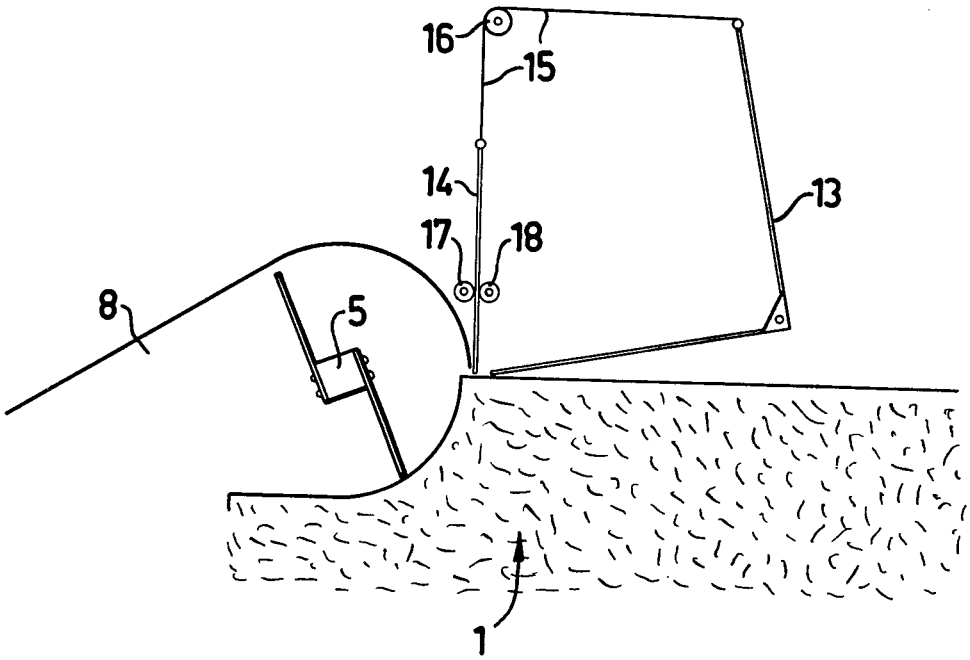

FIGS. 1 and 6 show a side view of a machine according to the invention,

FIGS. 2 and 3 the working tools,

FIG. 4 the profile of the pulp bale against the tools in working and

Figure 5:
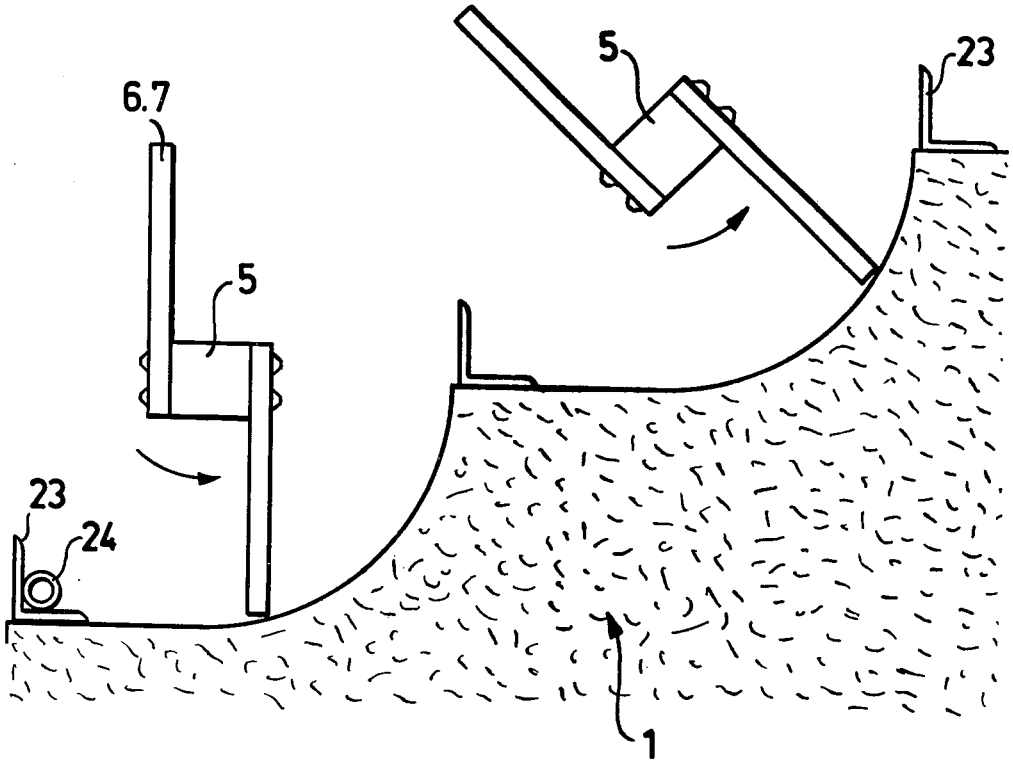
Figure 7A:
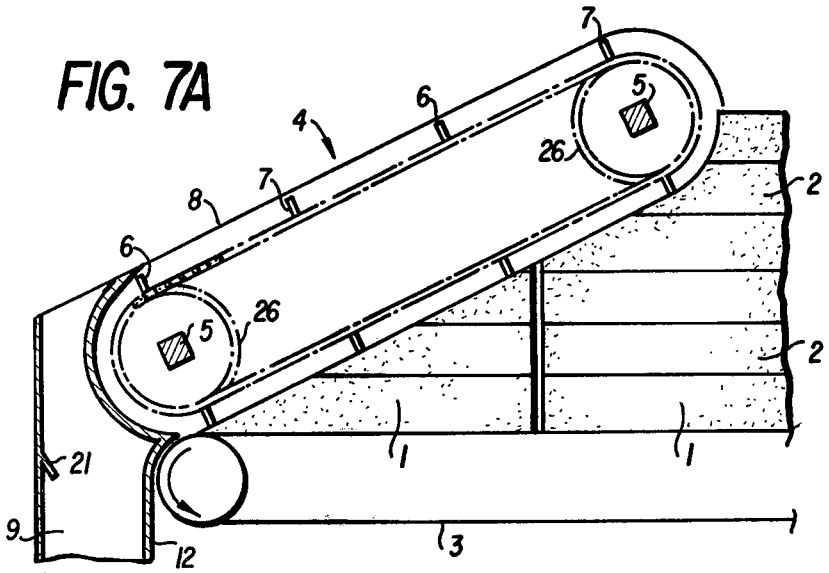
Figure 7B:
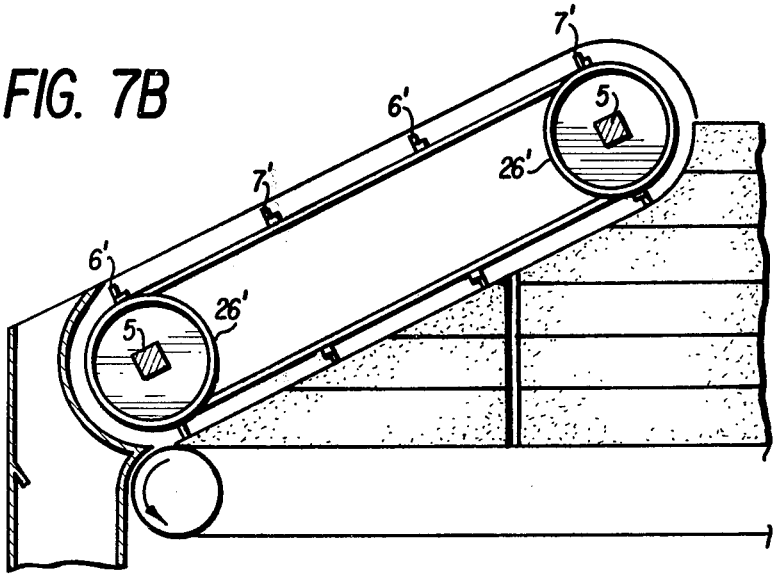

FIG. 5 a detailed drawing of two shafts with tools (6, 7), stops (23), and FIG. 7A and 7B show modified embodiments of the present invention employing chains and belts for transporting the working tools into contact with bale or the like.

In FIG. 1 a machine according to the invention is shown for stripping bales 1 consisting of slabs 2. These bales 1 are fed by means of a conveyor belt 3 towards a stripping means, which as a whole is designated by 4. This stripping means consists of parallel horizontal shafts arranged in a common plane inclined relative to the longitudinal direction of the bales, which shafts are brought to rotate in a way not shown in detail. The shafts rotate counterclockwise. Tools 6, 7 are attached to the shafts, which strip the bale when the bale is fed forwards by striking against fiber layers and lifting them away from the bale. The stripping means is provided with a guide plate 8 on its side turned from the bale, which plate leads the material broken away from the bale down into a store 9 arranged below. A strainer plate 22 with holes of about 15 mm is arranged between the store 9 and the stripping means 4 so that possible too big bale pieces cannot fall down into the store but are again pulled along and worked by the tools 6, 7. The fibers are removed from the store 9 by a conveyor belt provided with dogs, the lower edge of the store serving on one side as a stripper 11 of the conveyor 10 so that an even discharge of fibers is obtained from the store. Tnis conveyor leads to a machine for fine defibration of the pulp not shown. The side 12 opposite to the stripper is upwardly directly connected to the conveyor 3 feeding bales. Moreover the guide plate 8 and the store 9 are connected with side plates not shown for the sake of clearness. In the store 9 a level switch 21 is arranged to disconnect the bale conveyor when the store is filled in order that damage to the plant should not occur and to obtain a work-saving, automatic operation of the machine.

On top of the bales 1 two guide plates 13 and 14 are arranged, partly as a protection for the spreading of the fibers, partly for the tools. These protective plates, of which one 14 is plane and the other 13 is angular, are connected with a wire 15 via a pulley 16, so that the angular plate 13, which is pivoted at its corner, senses the bale height and adjusts the height of the guide plate 14 arranged between guide rolls 17 and 18 so that this will effectively shield the stripping means. Possibly the position of these protective shields can guide the feed speed of the conveyor 3 so that the amount of stripped pulp from the stripping means is constant apart from the thicknesses of the bales. This guiding can e.g. in a way known per se take place by means of thyristors. Along the conveyor 3 the bales can be laterally guided by means of guide rolls not shown.

The shafts rotating counterclockwise are shown more closely in FIGS. 2 and 3. The tools 6 and 7 are mounted in pairs on the shafts 5 by means of rivet joints 19 in an opposite direction from the shafts so that the tools 6 and 7 in a tool pair at rotation work the same groove after each other. The tools are pointed so that V-shaped grooves are obtained in the bale. However, the tool 6 is more pointed and somewhat longer than the tool 7, which results in the groove profile shown in FIG. 4. Moreover the tools 6 and 7 are arranged alternately along the shafts 5 so that the broader tools 7 will achieve the aforesaid alternate strokes on the backs between the grooves with accompanying loose breaking of fibers, as is shown to the left in FIG. 4.

In FIG. 5 it is finally shown how stops are arranged between the shafts provided with tools in the form of angular irons 23 so that too big pieces cannot be broken away. This stopping effect can also be achieved by a synchronization in accordance with FIG. 1 of the different shafts 5 so that the tools on the closest shaft serves as a stop. This can also result in a more even load on the drive motor of the stripping means. If it is desired to reduce the dry content, a pipe 24 for supply of vapour or water to the pulp and provided with holes for spreading is arranged in at least the lowermost of these angular irons or elsewhere.

In order to obtain such an even feeding as possible from the store to the finishing means for fine defibration and consequently to the final product the stripping means 4 and the conveyor 3 are dimensioned for a greater capacity than what is otherwise required so that there is always enough material in the store, in which the level switch 21 is arranged to disconnect the conveyor 3 when the store is filled.

According to the inventive idea it is essential that the tools have no cutting edges which might bring cutting of the fibers. As is apparent from FIG. 2 they need not be radially directed out of the center point of the shaft, either, but can be displaced so that they form a positive or negative angle with the radius of rotation.

Working in accordance with the invention i.a. also takes place with tools of two different types, 6 and 7. It is the object of the former tool 6 to make grooves in the surface of the bale with a suitable width at a suitable distance from each other. This tool has deep action and is longer than the latter. After the tool 6 has made a groove, this is widened towards the sides of the tool 7, which therefore has effect substantially laterally. The tools are arranged systematically on their shafts in a way as is apparent from FIGS. 2 and 3. It is apparent from these that the tools are arranged in two rows (a and b) which may of course be more. The tools can also be arranged on e.g. circle sectors. In each row of tools every other tool is of type 6 and the others of type 7. After the working of the surface of the bale has reached continuity the surface has obtained the appearance evident from FIG. 4. If the grooves are designated from left to right by A, B, C, D etc. the tools in line a will be in the following grooves at the same time: the tool a6 in the groove A, the tool a7 in the groove B, the tool a6 in the groove C, the tool a7 in the groove D and so on. After the shaft has rotated half a revolution the tools are in the following grooves: the tool b7 in the groove A, the tool b6 in the groove B, the tool b7 in the groove C, the tool b6 in the groove D and so on. The backs shown in FIG. 4 are exposed to strokes by turns by the tool 7 on both sides of the back sides. The backs are broken due to these alternating strokes on the back sides in a way as is evident from FIG. 4. As the tool 6 is narrower than the tool 7 there is expansion space for the movements of the backs laterally before they are completely broken. Working in accordance with the invention is in this respect a breaking more than a stripping. When breaking the backs the bonds between the fiber agglomerates will break where they are weakest. In this way a defibration is achieved quite without or with a minimum of destroying of the separate fibers.

A considerable part of the defibration work is also carried out by the loose material being in rapid motion and exerting a considerable friction against the surface of the bale and the fibers still adhering thereto. This fiber-to-fiber-friction is maintained by the tools on the rotating shafts. When the fiber material has been made free within the working range of the lower shaft, the material is moved by the material of the tools in their rotation direction along the surface of the bale and is thrown straight upwards, in the direction of the tangent, into the tool periphery of the overhead shaft, where it is caught and moved again along the surface of the bale under friction with still adhering fibers. This is repeated until the material is moved downwards again by the upper portion of the guide plate on the opposite side of the stripping means (4) and is thrown downwards towards the strainer plate (22) at a great speed. The fiber agglomerates, which are still too big to pass through the holes of the strainer plate, are moved on by the tool tips of the lowermost shaft, passing over the surface of the strainer plate at a distance of about 3 mm and are expposed to a new treatment at a renewed consecutive working in the stripping means (4).

The process described above for stripping of pulp bales of flake dried pulp and the means for this are also very suitable for stripping of pulp taken up in conventional manner in a belt drier, i.e. pulp in sheet form. Such a pulp bale is fed into the machine with horizontal sheets. The horizontal sheets are then exposed to the same attacks by the tools as described above in respect of the fiber layers in flake-dried pulp. What differs the two pulp types from each other in respect of working is that the fibers in the sheet pulp (belt-dried pulp) are more or less oriented as to their direction as distinguished from the fibers in flake-dried pulp. Therefore the sheet pulp will be much tougher and more difficult to strip. A consequence thereof is that the breaking effect described above will be less, and the backs are not broken until they have been higher and exposed to a stronger influence by the tools.

In the embodiment shown on the drawing the tools have been arranged on a rotating shaft, but the tools can also be arranged consecutively on one or more chains or belts running around wheels or pulleys, as shown in FIGS. 7A and 7B. In particular, FIG. 7A shows a plurality of tools 6 and 7 mounted on a chain extending about a pair of spaced sprockets 26. In comparison, FIG. 7B shows a plurality of tools 6' and 7' mounted on a belt extending about a pair of spaced pulleys 26'. Another modification is to arrange the tools on e.g. eccentrically driven, possibly guide-controlled tool rods, which give the tools an upward motion when they touch the surface of the pulp bale.

What is claimed is:

1. A method of stripping pulp bales, comprising the steps of:

relatively moving a first group of tools and a surface of a bale against each other to strip pulp from the bale by forming a plurality of parallel grooves on said surface which are defined by opposing sidewalls, relatively moving a second, different group of tools and said surface of the bale against each other to strip pulp from the bale by contacting the opposing sidewalls of said parallel grooves.

2. A method according to claim 1, wherein the tools of said first group of tools form ridges between said grooves and the tools of said second group of tools strip pulp from the bale by breaking said ridges away from said bale on contacting said sidewalls of said parallel grooves.

3. A method according to claim 2, wherein said ridges are broken away from said bale by being moved back and forth in a direction essentially perpendicular to said grooves.

4. A method according to claim 3, wherein a tool of said first group of tools forms a first groove while a tool of said second group of tools contacts the sidewalls of a second groove adjacent said first groove, whereupon a tool of said second group of tools contacts the sidewalls of said first groove while a tool of said first group of tools engages said second adjacent groove for providing said moving of a ridge between said first and second grooves back and forth.

5. A method according to claim 1, further comprising the step of moving portions of pulp broken away from said bale along said grooves, whereby a friction effect is obtained between said broken away portions and said bale thereby improving the stripping of said bale.

6. A method according to claim 1, further comprising the steps of removing pulp stripped from said bale to a receiver after said pulp has been reduced to a predetermined maximum size and recirculating the remainder of said pulp along said grooves until said remainder is reduced to said predetermined size.

7. A method according to claim 1, further comprising the steps of collecting stripped pulp in a receiver volume, monitoring the level in said receiver volume, controlling said moving of said tools and said bale surface in relation to each other as a function of said level, and feeding stripped pulp from said receiver volume for further processing.

8. A method of stripping pulp bales, comprising the steps of:

conveying a bale along a path toward a stripping means which comprises at least one shaft having at least one first tool pair extending therefrom, one member of said first pair having a narrow angle tip and the other member of said first pair having a wide angle tip; said shaft having at least one second tool pair extending therefrom, one member of said second pair having a narrow angle tip and being positioned to follow the other member of said first pair as said shaft rotates and the other member of said second pair having a wide angle tip and being positioned to follow the one member of said first pair as said shaft rotates;

rotating said shaft so that said tool pairs contact said bale in a direction opposite to the direction of bale movement;

stripping pulp from said bale with said at least one first tool pair and said at least one second tool pair by forming grooves in said pulp bale with said tool pairs, said grooves having ridges therebetween;

displacing said ridges alternately back and forth as said wide and narrow angle tips are moved alternately past opposite sides of said ridges, whereby said ridges are broken away from said bale.

9. A method according to claim 8, wherein said displacing causes said ridges to move back and forth in a direction essentially perpendicular to said grooves.

10. A method according to claim 8, further comprising the step of moving portions of said ridges broken away from said bale along said grooves, whereby a friction effect is obtained between said broken away portions and said bale thereby improving the stripping of said bale.

11. A method according to claim 8, further comprising the steps of removing pulp stripped from said bale to a receiver after said pulp has been reduced to a predetermined maximum size; and recirculating the remainder of said pulp along said grooves until said remainder is reduced to said predetermined size.

12. A method according to claim 8, further comprising the steps of collecting stripped pulp in a receiver volume, monitoring the level in said receiver volume; controlling said conveyor as a function of said level; and feeding stripped pulp from said receiver volume for further processing.

13. Apparatus for stripping pulp bales comprising:

means for conveying pulp bales along a predetermined path;

a first group of tools for contacting and forming a plurality of parallel grooves on a surface of said bale, with said grooves defined by opposing sidewalls;

a second, different group of tools for stripping pulp from the bale by contacting the opposing sidewalls of said parallel grooves.

14. Apparatus according to claim 13, wherein each tool of said first group of tools has a narrow angle tip and each tool of said second group of tools has a wide angle tip.

15. Apparatus according to claim 13, further comprising moveable means for supporting said groups of tools.

16. Apparatus according to claim 15, said tools protruding from said support means, each tool of said first group of tools having a tip positioned at a greater distance from said support means than a tip of each tool of said second group of tools.

17. Apparatus according to claim 15, said moveable support means comprising at least one shaft mounted for rotation and positioned for moving said groups of tools transversely to said surface of said bale.

18. Apparatus according to claim 15, said moveable support means comprising at least one belt positioned for moving said groups of tools transversely to said surface of said bale.

19. Apparatus according to claim 15, said moveable support means comprising at least one chain positioned for moving said groups of tools transversely to said surface of said bale.

20. Apparatus according to claim 15, said moveable support means comprising bars positioned for moving said groups of said tools transversely to said surface of said bale.

21. Apparatus according to claim 15, said moveable support means comprising a plurality of parallel shafts mounted for rotation above said conveying means and oriented transversely to the direction of movement of said conveying means, each of said shafts carrying first and second groups of tools; and stop means arranged adjacent said plurality of shafts in position to contact said bale for preventing tools on each shaft from stripping excessively large pieces of pulp from said bale.

22. Apparatus for stripping pulp bales, comprising;

means for conveying pulp bales along a path;

at least one shaft mounted for rotation above said conveying means and oriented transversely to the direction of movement of said conveying means;

at least one first tool pair extending from said shaft, one member of said first pair having a narrow angle tip and the other member of said first pair having a wide angle tip; and at least one second tool pair extending from said shaft, one member of said second pair having a narrow angle tip and being positioned to follow the other member of said first pair as said shaft rotates, and the other member of said second pair having a wide angle tip and being positioned to follow the one member of said first pair as said shaft rotates;

whereby said tool pairs form parallel grooves in said bale, said grooves having ridges therebetween, said ridges being displaced alternately back and forth as said wide and narrow angle tips are moved alternately past opposite sides of said ridges, thereby breaking said ridges away from said bale.

* * * * *